US005108355A

United States Patent [19]

Walsh

[11] Patent Number: 5,108,355

[45] Date of Patent: Apr. 28, 1992

[54] METHOD AND APPARATUS FOR ATTACHING INSERT PANELS TO CARTON BLANKS

[75] Inventor: Joseph C. Walsh, Longmont, Colo.

[73] Assignee: Graphic Packaging Corporation, Paoli, Pa.

[21] Appl. No.: 579,854

[22] Filed: Sep. 7, 1990

[51] Int. Cl.[5] ..... B31B 7/02; B31B 17/04

[52] U.S. Cl. ..... 493/89; 493/110

[58] Field of Search ..... 493/10, 29, 84, 89, 493/94, 95, 110, 379

[56] References Cited

U.S. PATENT DOCUMENTS 2,015,202 9/1935 Stokes ..... 493/110
4,368,052 1/1983 Bitsky et al. ..... 493/96
4,650,448 3/1987 Urso ..... 493/89
4,668,212 5/1987 Kotani ..... 493/10

*Primary Examiner*—William E. Terrell
*Attorney, Agent, or Firm*—Klaas & Law

[57] ABSTRACT

An apparatus for attaching insert panels to carton blanks including: a carton blank conveyor for moving carton blanks along a predetermined displacement path; a carton blank folder positioned at a fixed station along the displacement path for folding an end panel portion of each passing carton blank for providing an abutment surface for engaging a carton insert panel; an insert panel applicator positioned at a fixed station along the displacement path for applying an insert panel to each passing carton blank; a registration assembly for urging a predetermined edge portion of each insert panel into abutment with the abutment surface on each folded carton blank.

17 Claims, 4 Drawing Sheets

METHOD AND APPARATUS FOR ATTACHING INSERT PANELS TO CARTON BLANKS

BACKGROUND OF THE INVENTION

The present invention relates to carton forming methods and apparatus and, more particularly, to a method and apparatus for attaching carton reinforcing insert panels to carton blanks prior to folding and gluing of the blanks and panels to provide reinforced cartons.

Most modern container cartons are formed from unitary carton blanks which are folded along precut score lines and glued together in a high speed operation (e.g. 800 cartons per minute) by an apparatus known in the packaging industry as a folder/gluer machine.

Recently certain container cartons, which are adapted to hold relatively high density material such as concentrated laundry detergent, have been reinforced with an insert panel which is attached to the primary carton blank. The primary carton blank and the attached insert panel are folded and glued in a traditional manner by a conventional folder/gluer machine to provide a container carton. In such a reinforced carton forming operation, each insert panel must be properly aligned with and affixed to an associated primary carton blank before the traditional folding and gluing operation begins.

One prior art device which performs the functions of alignment and attachment of insert panels is manufactured and sold by Jagenberg Inc. of Freshwater Blvd., P.O. Box 188 Enfield, Conn., 06082 under the product designation "Inlet Spotter". A problem with such apparatus has been that they operate relatively slowly as compared to the traditional folder/gluer machines into which the carton blanks and attached insert panels are subsequently fed. As a result the cost for forming insert panel reinforced cartons is significantly higher than the cost for forming unitary blank cartons.

OBJECTS OF THE INVENTION

It is an object of the present invention to provide a method and apparatus for aligning and attaching insert panels to carton blanks which is substantially faster and more cost effective than prior art machines which perform this function.

It is another object of the present invention to provide a method and apparatus for aligning and attaching insert panels to carton blanks in which an edge portion of an insert panel is urged into positive engagement with an associated folded surface of a container carton blank in order to enable registration to be achieved in a relatively high speed operation.

SUMMARY OF THE INVENTION

The present invention is directed to a method and apparatus for attaching insert panels to carton blanks in a predetermined alignment configuration which enables the carton blanks and attached insert panels to be fed directly into a conventional folder/gluer machine in a continuous, high speed operation.

The invention may comprise an apparatus for attaching insert panels to carton blanks comprising: carton blank conveyor means for moving carton blanks along a predetermined displacement path; carton blank folder means positioned at a fixed station along said displacement path for folding an end panel portion of each passing carton blank for providing an abutment surface for engaging a carton insert panel; insert panel applicator means positioned at a fixed station along said displacement path for applying an insert panel to each passing carton blank; registration means for urging a predetermined edge portion of each insert panel into abutment with said abutment surface on each folded carton blank.

The invention may also comprise an apparatus for attaching insert panels of the type each having a top surface, a bottom surface, a leading edge portion and a trailing edge portion to carton blanks of the type each having a top surface, a bottom surface and a plurality of score lines defining a set of sidewall panels, a first set of end panels attached at first ends of said sidewall panels and defining a leading edge portion of said carton blank and a second set of end panels attached at second ends of said sidewall panels and defining a trailing edge portion of said carton blank, comprising: carton blank single feeder means for feeding said carton blanks, one at a time, to a carton blank conveyor means; carton blank conveyor means for conveying carton blanks in bottom surface down, leading edge first, spaced apart, single file relationship along a carton blank displacement path; carton blank lug means affixed at equal interval spacing to said carton blank conveyor means for engaging said trailing edge portion of each carton blank fed to said conveyor means for maintaining a predetermined spacing interval between carton blanks on said carton blank conveyor belt means; end panel folder means for folding at least one of said second set of end panels about a score line which separates it from an associated sidewall panel such that said folded end panel is positioned in overlying relationship with said associated sidewall panel; first end panel hold down means positioned above said carton blank displacement path for maintaining said folded end panel in overlying relationship with said associated sidewall panel along a first predetermined length of said carton blank displacement path; carton blank sensor means positioned at a fixed sensing station along said displacement path for sensing the passage of a carton blank and for generating a carton blank sensing signal in response thereto; adhesive applicator means positioned at a fixed location above said displacement path downstream from said sensing station and responsive to said sensor signal for applying adhesive to said top surface of each carton blank at a predetermined region thereof; insert panel single feeder means responsive to said sensor signal for feeding one of said insert panels to an insert panel conveyor means in response to the detection of a carton blank by said sensor means; insert panel conveyor means for conveying insert panels in single file relationship along an insert panel displacement path and for depositing each insert panel onto a below passing carton blank moving along said carton blank displacement path, said insert panel conveyor means coacting with said folded end panel of each carton blank subsequent to it disengagement from said first hold down means for maintaining said folded end panel in overlying relationship with said associated sidewall panel until said folded end panel is engaged by a second end panel hold down means; insert panel lug means affixed at equal interval spacing to said conveyor means for engaging said trailing edge portion of each insert panel fed to said insert panel conveyor means for maintaining a predetermined spacing interval between insert panels on said insert panel conveyor belt means, the movement of said insert panel lug means being timed relative to the movement of said carton blank lug means such that each infed insert panel is deposited on top of a sensed carton blank at a position thereon forward of the forwardmost edge of said folded end panel on said carton blank; drag means positioned along said carton blank displacement path for applying a retarding force to each insert panel after it leaves said insert panel conveyor means for displacing said insert panel rearwardly relative to a container blank upon which it is deposited for urging said trailing edge portion of said insert panel into abutting relationship with said folded end panel on said container blank: compression nip means positioned along said carton displacement path downstream of said drag means for applying compressive force to each carton blank and an associated insert panel in said predetermined region where said adhesive has been applied to said carton blank; second end panel hold down means positioned above said carton blank displacement path for maintaining said folded end panel in overlying relationship with said associated sidewall panel along a second predetermined length of said carton blank displacement path; whereby each insert panel is adhesively attached to a carton blank with said insert panel trailing edge positioned in registration with a score line which separates a carton blank sidewall panel from an associated second end panel.

The invention may also comprise an apparatus for attaching a first sheet of material to a second sheet of material comprising: first sheet conveyor means for moving said first sheet along a predetermined displacement path; first sheet deformer means positioned at a fixed station along said displacement path for deforming a portion of each said first sheet for providing an abutment surface for engaging an edge portion of said second sheet; second sheet applicator means positioned at a fixed station along said displacement path for applying said second sheet to said first sheet; registration means for urging said edge portion of said second sheet into abutting relationship with said abutment surface on said first sheet.

The invention may also comprise a method of preparing a plurality of flat carton blanks and flat insert panels for folding and gluing into reinforced carton configurations comprising the steps of: moving the carton blanks along a predetermined displacement path; deforming each carton blank to provide a surface projecting transversely of the direction of carton displacement; laying an insert panel on said one flat surface of each carton blank moving along said displacement path; placing each insert panel in a predetermined registration position with an associated carton blank by urging a predetermined edge portion of each insert panel into abutting relationship with said projecting surface on an associated carton blank; fixedly attaching each registeringly positioned insert panel to each associated carton blank.

BRIEF DESCRIPTION OF THE DRAWING

An illustrative and presently preferred embodiment of the invention is shown in the accompanying drawings in which.

DETAILED DESCRIPTION OF THE INVENTION

Prior Art

Figure 1:
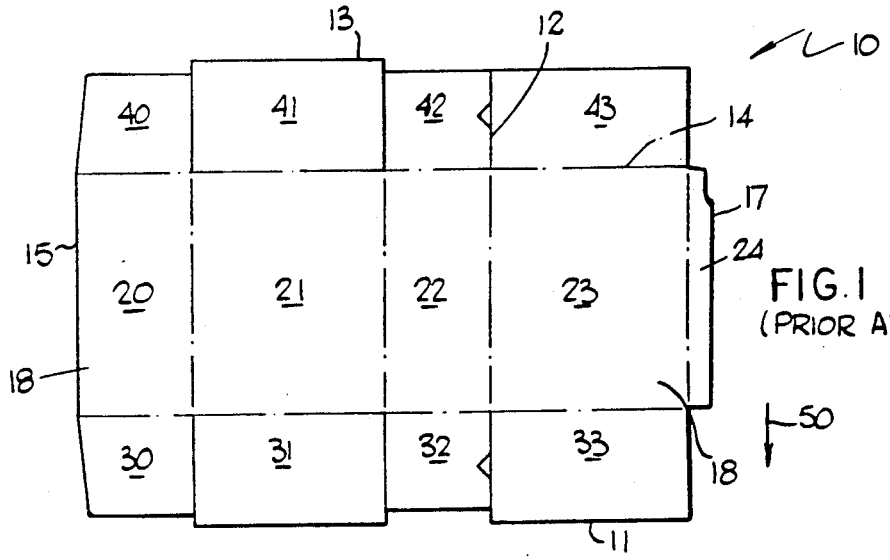
FIG. 1 (PRIOR ART)
FIG. 1 is a top plan view of a carton blank.

A prior art carton blank 10 is illustrated in FIG. 1. The carton blank has a leading edge 11, a trailing edge 13, and a pair of lateral side edges 15, 17, as defined with reference to a machine direction 50 in which the carton blank moves as it passes through a conventional folder/-gluer apparatus 106, FIG. 3. The carton blank 10 has a gridwork of score lines 12, 14, etc., provided on a flat top surface portion 18 thereof. The score lines separate the carton blank into a plurality of panels including sidewall panels 20–23, sidewall glue tab panel 24, leading edge endwall panels 30–33, and trailing edge panels 40–43. The blank 10 has a flat bottom surface portion 19 parallel to the top surface 18, FIG. 3, and may be formed from 0.010 to 0.050 inch thick paperboard.

Figure 2:
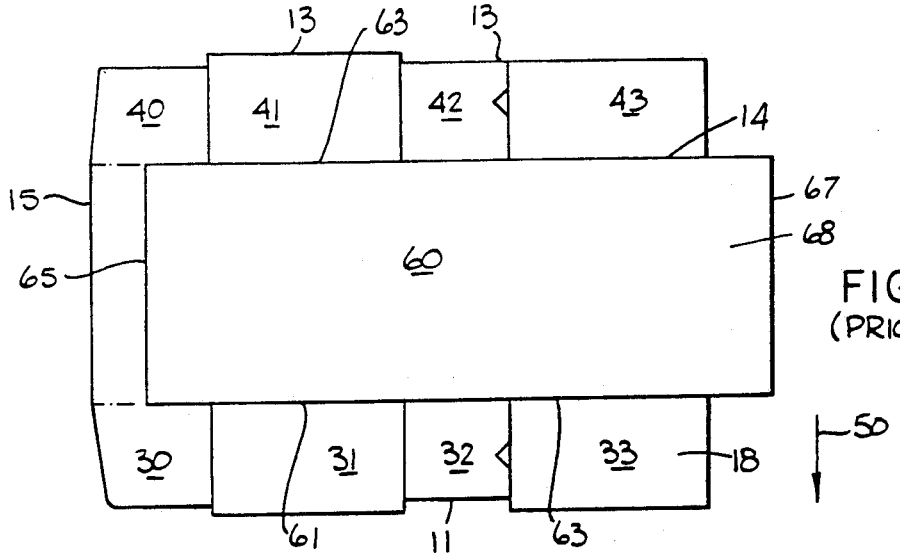
FIG. 2 (PRIOR ART)
FIG. 2 is a top plan view of a carton blank with an insert panel attached thereto.

The carton blank 10 is of a type which is adapted to be attached to a reinforcing insert panel 60, FIG. 2, prior to being folded in a conventional folder/gluer machine 106. The insert panel comprises a leading edge 61, a trailing edge 63, a first lateral side edge 65, a second lateral side edge 67, a top surface portion 68, and a bottom surface portion 69, FIG. 3. The bottom surface potion of the insert panel is attached to the top surface portion of the carton blank by adhesive. The insert panel may be constructed from single sheet paperboard or may be formed from corrugated paperboard, etc.

Figure 3:
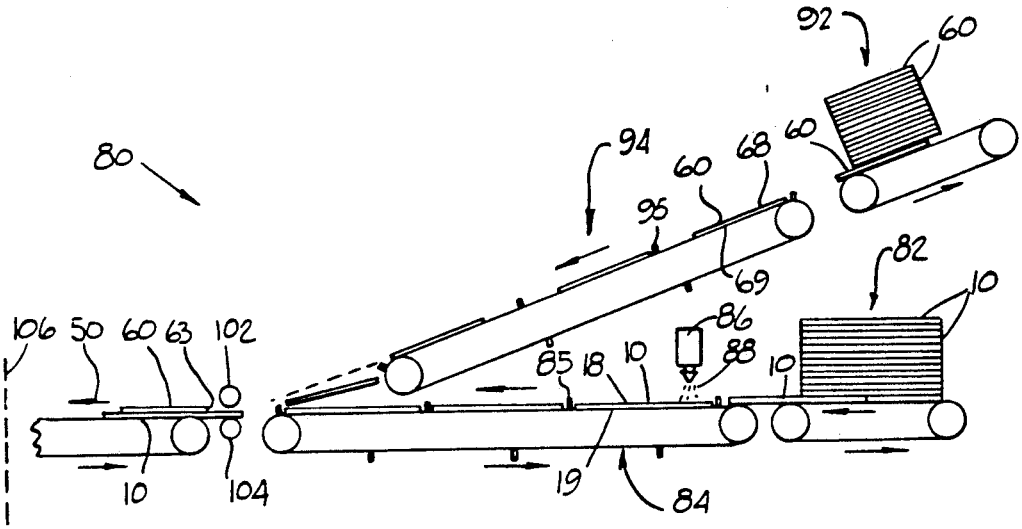
FIG. 3 (PRIOR ART)
FIG. 3 is a schematic elevation view of a prior art apparatus for attaching insert panels to carton blanks.

A prior art device 80 for attaching a plurality of insert panels 60 to a plurality of carton blanks 10 in a continuous machine operation is illustrated in FIG. 3. The device comprises a carton blank sheet feeder 82 which feeds blanks one at a time to a carton blank conveyor 84 which is provided with a plurality of timing lugs 85 which engage the trailing edge 13 of each carton blank and move the carton blanks along a preset path. An adhesive applicator 86 is provided at a station along the path and applies a molted strip of fast drying adhesive 88 to each blank. An insert panel sheet feeder 92 is positioned above the carton blank conveyor and feeds insert panels 60 one at a time into an insert panel conveyor 94 with panel engaging lugs 95. The insert panel conveyor moves the insert panels along a path which converges with the carton blank conveyor path. The insert panel conveyor and the carton blank conveyor are precisely speed matched and synchronized with one another such that each insert panel is deposited with its trailing edge 63 in registry with score line 14 of a carton blank 10.

THE INVENTION

Figure 4:
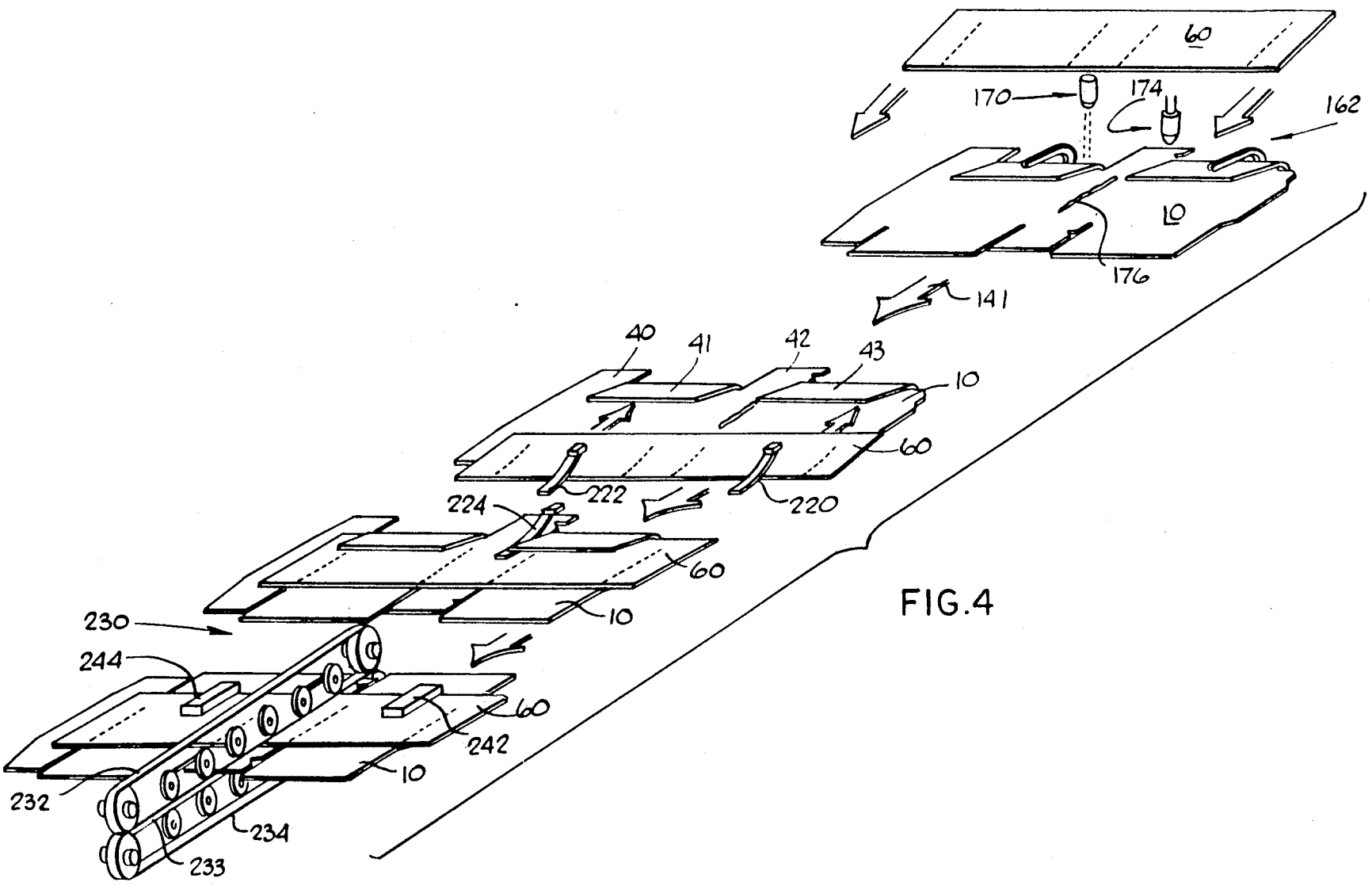
FIG. 4 is a schematic perspective view of an apparatus for attaching insert panels to carton blanks.
Figure 5:
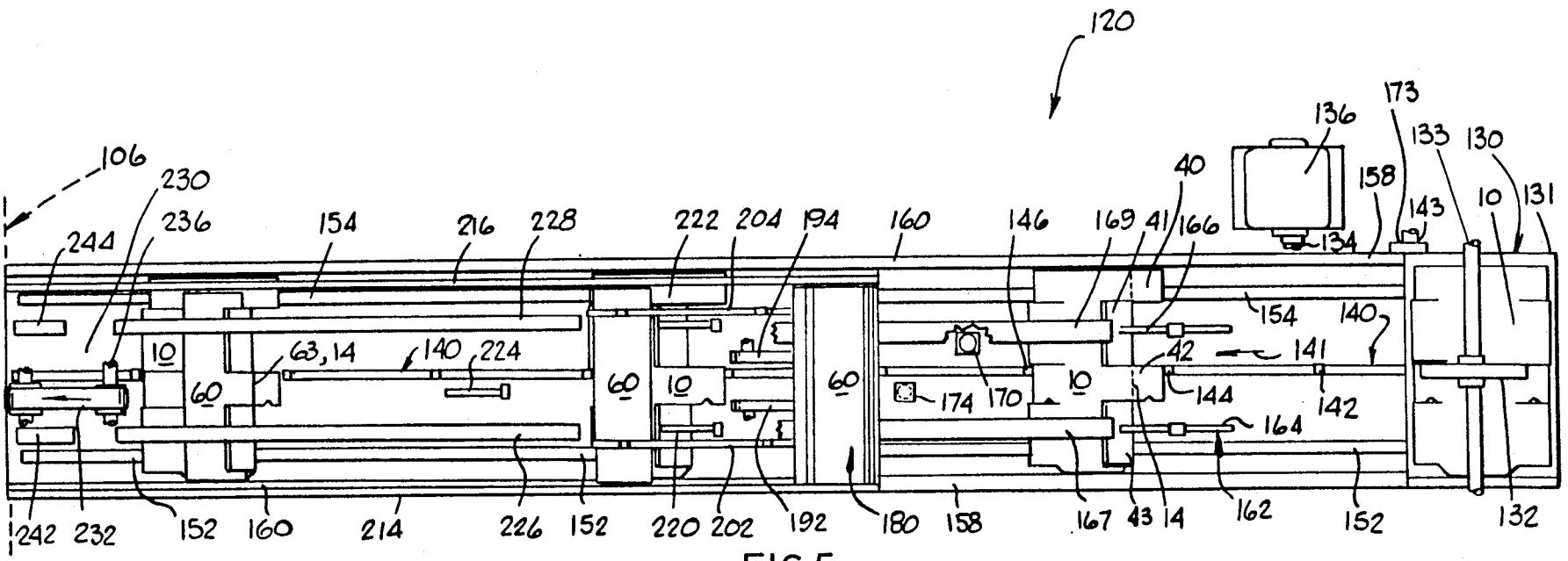
FIG. 5 is a top plan view of an apparatus for attaching insert panels to carton blanks.
Figure 6:
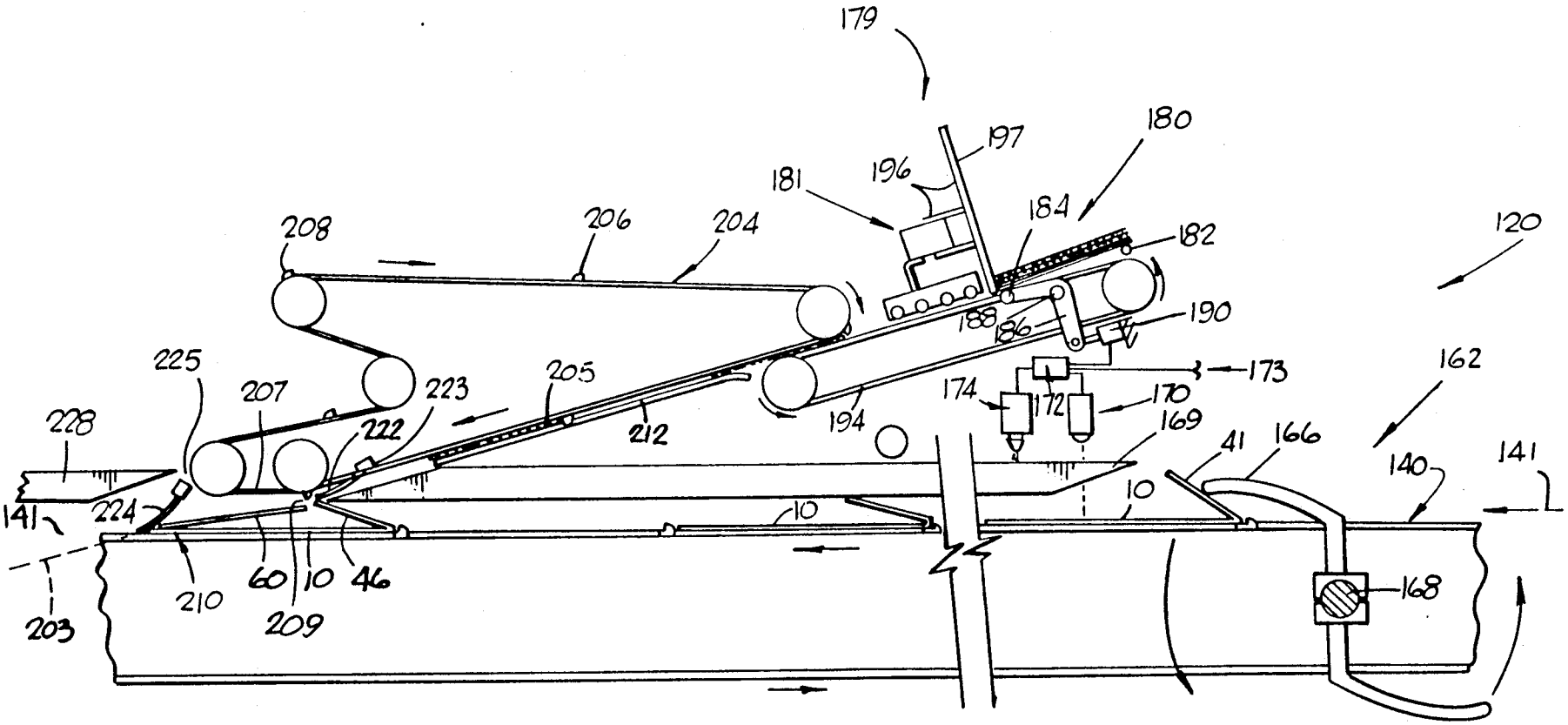
FIG. 6 is a detail, broken side elevation view of an apparatus for attaching insert panels to carton blanks.

FIGS. 4, 5 and 6 illustrate an apparatus 120 for attaching insert panels 60 to carton blanks 10 which, in general, comprises a carton blank conveyor 140 for moving carton blanks 10 along a predetermined displacement path 141; a carton blank folder assembly 162 positioned at a fixed station along the displacement path 141 for folding end panel portions, e.g. 41, 43, of each passing carton blank for providing an abutment surface e.g. 46, FIG. 6, for engaging an insert panel 60; an insert panel applicator 192, 194, 202, 204, etc., positioned at a fixed station along the displacement path 141 for applying an insert panel to each passing carton blank; and a registration assembly 220, 222, 224, for urging a predetermined edge portion 61 of each insert panel into abutment with the abutment surface 46 on each folded carton blank next adjacent to score line 14.

Having thus described an apparatus of the present invention in general, apparatus 120 will now be described more specifically.

Apparatus 120 includes a one at a time carton feeder assembly 130, FIG. 5, which may be of a conventional type comprising a conventional biasing holder 131 which holds a stack of carton blanks 10 therein and urges a top carton blank in the stack against a rotating feeder wheel 132. Rotating feeder wheel 132 is of a conventional construction well known in the art comprising a small circumferential region which frictionally engages and removes the top carton blank from the stack during each rotation of the wheel and which thus feeds the carton blanks one at a time to a carton blank conveyor belt 140. The feeder wheel 132 is rotated by a shaft 133 which is mechanically linked to the drive shaft 134 of a drive motor 136.

A horizontally disposed carton blank conveyor belt 140 defines a carton blank displacement path 141 along which carton blanks 10 are moved during an insertion panel mounting and attachment process. The conveyor belt 140 may be an endless chain conveyor having a conveyor drive shaft 143 which is conventionally mechanically linked to drive motor shaft 134. The respective gear ratios of the linkage of shaft 133 and shaft 143 is such that the linear surface speed of conveyor belt 140 is faster than the linear surface speed of feeder wheel 132, e.g. twice as fast. The conveyor belt 140 is provided with a plurality of timing lugs 140, 142, 144, 146, etc., which are longitudinally spaced at intervals slightly longer than the distance between the leading edge and trailing edge of each carton blank 10, e.g. 0.5 inch longer. Adjacent lugs are adapted to, at different times, engage the leading edge 11 and the trailing edge 13 of a carton blank positioned therebetween. In one preferred embodiment of the invention in which the surface speed of the conveyor belt 140 is approximately twice the surface speed of feeder wheel 132, the belt 140 is synchronized with respect to the wheel such that a carton blank is fed to the conveyor belt between every other pair of lugs. (In FIG. 5, only three carton blanks 10 are shown on the conveyor 140 to avoid clutter.)

A pair of bottom support rails 152, 154 are disposed in the same plane as the upper surface of conveyor belt 140 and support the outer lateral portions of each carton blank 10 as it is moved along path 141.

A first and second lateral guide rail 158, 160 which extend parallel to path 141 engage the later edge portions 15, 17 of each blank 10 and maintain the edge portions in parallel alignment with path 141.

A folder assembly 162 is provided at an operating station downstream from the beginning of conveyor belt 140. The folder assembly comprises a first and second rotating folder member 164, 166 of a conventional construction well known in the art. Folder members 164, 166 are mounted on a rotary shaft 168, FIG. 6, which is mechanically linked to drive motor shaft 134 by conventional linkage. The rotation rate of the members 164, 166 is such that the members engage the trailing edge panels 41, 43 of each passing carton blank and, due to the greater linear speed of members 164, 166, cause the end panels 41, 43, to be folded upwardly and forwardly about score line 14. The carton blank is prevented from slipping more than a short distance forward on the conveyor belt 140 during this process by the forwardly positioned conveyor lug, e.g. 146. The panels are folded forward substantially more than 90 degrees, e.g. 120 degrees, during their periods of engagement with members 164, 166. At approximately the same time that engagement with members 164, 166 terminates the folded end flaps 41, 43 are engaged by a first set of hold down rails 167, 169 which hold the associated end flaps in a relatively folded position in overlying relationship with the remainder of the carton blank 10, as best illustrated in FIG. 6.

A photo eye assembly 170 which is adapted to sense a leading edge portion 11 of each passing carton blank is positioned above the displacement path at a location downstream of the folder assembly 162. The photo eye assembly 170 may be a conventional LED/optical sensor pair of a type well known in the art. The photo eye assembly generates a signal indicative of the passage of the leading edge of a carton which it provides to a control assembly 172. Control assembly 172 also receives a line speed signal as from a conventional encoder unit 173 attached to conveyor shaft 143. The control assembly 172 in turn actuates an adhesive applicator 174 and an insert panel feed assembly 181 in response to the photo eye signal at a time determined by line speed.

The adhesive applicator 174 which is actuated in response to the photo eye signal is positioned at a preset distance downstream from the photo eye which is determined based upon the maximum operating speed of the conveyor belt 140 and the response time of the applicator. In one preferred embodiment the applicator is positioned so as to apply adhesive only to carton blank panel 22. The duration of the adhesive application is based upon the conveyor speed and may be controlled by control assembly 172. The adhesive 176 which is applied is preferably of a quick drying type such as are well known in the art.

An insert panel applicator assembly 179 is provided in overlying relationship with the carton blank conveyor 140 as best illustrated in FIG. 6. The panel applicator assembly comprises an insert panel holder 180 which supports a stack of insert panels 60 by means of a fixed support shaft 182 and a displaceable forward roller unit 184 which also comprises a portion of a one at a time panel feeder assembly 181. The forward roller unit 184 is mounted at one end of a pivot member 186 which pivots about a fixed pivot shaft 188 and which is pivotally attached at its lower end to the shaft of a solenoid cylinder unit 190 which is actuated by a signal from controller 172. Thus whenever a carton blank is sensed by photo eye unit 170 the solenoid shaft is retracted causing roller unit 184 to be displaced downwardly. A pair of matched speed conveyor belts 192, 194 are provided in a common plane which is positioned at an elevation which is below the elevation of the roller unit 184 when the solenoid 190 is in an extended position but which is above the elevation of the roller unit 184 when the solenoid is in a retracted position. Thus when the roller unit is lowered by the solenoid the bottom most insert panel in the holder 180 is placed in contact with conveyors 192 and 194 which frictionally engage it and pull it from the bottom of the stack. The remainder of the insert panels 60 remain stationary due to the fact that they are engaged by a "doctor blade" assembly 196 having an upright member 197 which has a bottom edge surface which is positioned at a distance of one insert panel thickness above the plane of the conveyor belts 192, 194 and which thus allows the passage of only one insert panel at a time when roller assembly 184 is lowered. The duration of the solenoid retracted state is sufficiently short such that only one insert panel is withdrawn from the stack per actuation. Both conveyor belts are drivingly linked to drive motor drive shaft 134 and operate at a speed proportionate to the speed of carton blank conveyor 140.

The conveyor belts 192, 194 feed each insert panel onto insert panel conveyor chains 202, 204 having a plurality of timing lugs 206, 208, etc. thereon which are adapted to engage the trailing edge portion 63 of each insert panel 60. Conveyor chains 202, 204 operate at the same speed and have laterally oppositely positioned lugs. Conveyor chains 202, 204 are drivingly linked to drive shaft 134 by conventional mechanical linkage and thus operate at a speed proportionate to that of carton blank conveyor 140. A support rail 212 (only one shown), FIG. 6, is positioned adjacent to and below each conveyor chain 202, 204 and vertically support insert panels engaged by conveyor chains 202, 204.

The insert panel movement path 203 defined by insert panel conveyor chains 202, 204 intersects carton blank movement path 141 at 210. Conveyor chains 202, 204 are synchronized with conveyor chain 140 such that each end panel 60 is deposited at approximately the same longitudinal position on a below passing carton blank 10. The position at which each insert panel is deposited on a passing carton blank is sufficiently forward on the blank such that the trailing edge 63 of the panel 60 is positioned forward of the terminal edge of the each of the forwardly folded panels 41, 43 as illustrated in FIGS. 4 and 6.

As illustrated by FIG. 5, a pair of lateral guide rails 214, 216 are provided which guide the lateral edge portions 65, 67 of each insert panel from the infeed assembly 181 to the end of the apparatus 120 so as to maintain the end panel lateral edge portions in parallel relationship, initially, with path 203 and, later, with path 141.

An upstream set of drag fingers 220, 222 are provided near the end of the insert panel conveyor chains 202, 204. The drag fingers may be constructed from spring steel and may be mounted on a transversely extending member 223, FIG. 6, positioned above the insert panel displacement path 203. Drag fingers 220 222 initially engage the leading edge portion of each insert panel 60 moving along path 203 urging it downwardly and into engagement with a below passing carton blank 10. Subsequent engagement of the drag fingers 220, 222 with the trailing edge portion of the insert panel facilitates its disengagement from the insert panel conveyor chain lugs.

A downstream drag finger 224 is supported on a transverse member positioned above the carton blank displacement path 141 at a position immediately downstream from the downstream end portion of the insert panel conveyor chains 202, 204. Drag finger 224 may also be constructed from spring steel. Drag finger 224 frictionally engages the upper surface of each insert panel which has been deposited on a passing carton blank at a lateral position thereon in alignment with unfolded carton blank end panel 42. This frictional surface engagement with drag finger 224 retards the forward movement of the insert panel along path 141 causing it to be displaced rearwardly relative to the underlying carton blank until its trailing edge portion 63 comes into engagement with the abutment surface 46 provided by each of the folded end panels 41, 43 at a position thereon immediately adjacent to and in parallel alignment with fold/score line 14.

As illustrated by FIG. 6, the insert panel conveyor chains 202, 204 have an inclined upstream portion 205 and a horizontally disposed downstream portion 207, both of which overlie and are parallel to the carton blank path 141. The horizontally disposed portion 207 of each of the conveyor chains 202, 204 is adapted to engage a terminal edge portion of each of the folded end panels of a passing carton blank to maintain the end panel in its folded position from a point 209 where the end panels leave engagement with the upstream set of hold down rails 167, 169 to a point 225 where the end panels are engaged by a downstream set of hold down rails 226, 228.

The downstream set of hold down rail 226, 228 are positioned in alignment with the upstream set of hold down rails 167, 169 and maintain the folded end panels 41, 43 in their folded position until the carton blank and associated insert panel have entered compression assembly 230.

As illustrated in FIGS. 4 and 5, the compression assembly comprises an upper idler compression belt 232 and a lower driven compression belt 234 which form a compression nip 233 therebetween and which are positioned in alignment with the sidewall panel 22 of each carton blank to which the adhesive material 176 has been applied. The upper and lower belts 232, 234 are both driven by a shaft 236 which is conventionally drivingly linked to drive shaft 134 of motor 136 and operate at a surface speed equal to or slightly faster than that of conveyor chain 140. In one preferred embodiment of the invention in which the fast drying adhesive 176 is product number HM4660 manufactured by H. B. Fuller having a business address of 200 Funston Road, Kansas City, Kans., the belts contact each carton blank and associated insert panel in a contact region 30 inches long and 1 inch wide. The belts operate at a maximum surface speed of 17 feet per second. The compression nip compresses the insert panel 60 and carton blank 10 and the adhesive 176 sandwiched therebetween to thereby firmly bond the insert panel 60 to the carton blank 10.

The downstream hold down rails 226, 228 terminate at a position approximately 30 inches downstream from the upstream end of the compression nip 233. Thus the folded end panels are retained in their folded position until after the associated carton blank and end panel have been engaged by the compression nip to ensured that the insert panel 60 is not moved from its registration position with the carton blank score line 14 prior to the compressive bonding which takes place at nip 233.

At a position approximately 3 to 5 inches downstream from the end of the downstream hold down rails 226, 228 and in alignment with rails 226 and 228 there are provided flip over members 242, 244 which each comprise a rounded and beveled upstream end which engage each of the folded end panels 41, 43 and fold the end panels backwardly into coplanar relationship with the remainder of the carton blank 10.

The compression belts 230, 232 may feed the carton blanks and attached insert panels directly into a conventional carton folder/gluer machine 106 or may feed the carton blanks and attached insert panels to a separate conveyor and/or collection tray (not shown) for separate collection and storage prior to processing by a folder/gluer machine.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. An apparatus for attaching insert panels to carton blanks comprising:

carton blank conveyor means for moving carton blanks along a predetermined displacement path;

carton blank folder means positioned at a fixed station along said displacement path for folding an end panel portion of each passing carton blank for providing an abutment surface for engaging an insert panel;

insert panel applicator means positioned at a fixed station along said displacement path for applying an insert panel to each passing carton blank;

registration means for urging a predetermined edge portion of each insert panel into abutment with said abutment surface on each folded carton blank.

2. The invention of claim 1 further comprising attachment means for fixedly attaching each insert panel to an associated carton blank wherein said attachment means comprises adhesive applicator means for applying adhesive to at least one of said carton blanks or said insert panels.

3. The invention of claim 1 further comprising attachment means for fixedly attaching each insert panel to an associated carton blank wherein said attachment means comprises compression means for compressing each carton blank and associated insert panel in the region of said adhesive.

4. The invention of claim 1 wherein said folder means comprises means for folding a trailing edge end panel portion of each carton blank.

5. The invention of claim 4 wherein each folder means folds said carton trailing edge panel upwardly and forwardly.

6. The invention of claim 1 further comprising hold down means positioned along said carton blank displacement path for holding each said end panel folded by said folder means in overlying relationship with the remainder of an associated carton blank for a predetermined distance of carton blank displacement along said displacement path.

7. The invention of claim 6 wherein said hold down means comprises a fixed rail positioned above said carton blank conveyor means.

8. The invention of claim 6 wherein said hold down means comprises a moving belt positioned above said carton blank conveyor means.

9. The invention of claim 8 wherein said moving belt means comprises a portion of said insert panel applicator means.

10. The invention of claim 1 wherein said registration means comprises drag means for applying a drag force to each said insert panel subsequent to its application to a carton blank for retarding the motion of said insert panel relative to the motion of said carton blank for urging said insert panel rearwardly into engagement with said abutment surface of said carton blank.

11. The invention of claim 1 further comprising carton blank detection means positioned along said displacement path upstream from said insert panel applicator means for detecting the passage of a carton blank and for generating a detection signal in response thereto and wherein said insert applicator means is actuated in response to said detection signal.

12. An apparatus for attaching insert panels of the type each having a top surface, a bottom surface, a leading edge portion and a trailing edge portion to carton blanks of the type each having a top surface, a bottom surface and a plurality of score lines defining a set of sidewall panels, a first set of end panels attached at first ends of said sidewall panels and defining a leading edge portion of said carton blank and a second set of end panels attached at second ends of said sidewall panels and defining a trailing edge portion of said carton blank, comprising:

carton blank single feeder means for feeding said carton blanks, one at a time, to a carton blank conveyor means;

carton blank conveyor means for conveying carton blanks in bottom surface down, leading edge first, spaced apart, single file relationship along a carton blank displacement path;

carton blank lug means affixed at equal interval spacing to said carton blank conveyor means for engaging said trailing edge portion of each carton blank fed to said conveyor means for maintaining a predetermined spacing interval between carton blanks on said carton blank conveyor belt means;

end panel folder means for folding at least one of said second set of end panels about a score line which separates it from an associated sidewall panel such that said folded end panel is positioned in overlying relationship with said associated sidewall panel;

panel hold down means positioned above said carton blank displacement path for maintaining said folded end panel in overlying relationship with said associated sidewall panel along a first predetermined length of said carton blank displacement path;

carton blank sensor means positioned at a fixed sensing station along said displacement path for sensing the passage of a carton blank and for generating a carton blank sensing signal in response thereto;

adhesive applicator means positioned at a fixed location above said displacement path downstream from said sensing station and responsive to said sensor signal for applying adhesive to said top surface of each carton blank at a predetermined region thereof;

insert panel single feeder means responsive to said sensor signal for feeding one of said insert panels to an insert panel conveyor means in response to the detection of a carton blank by said sensor means;

insert panel conveyor means for conveying insert panels in single file relationship along an insert panel displacement path and for depositing each insert panel onto a below passing carton blank moving along said carton blank displacement path, said insert panel conveyor means coacting with said folded end panel of each carton blank subsequent to it disengagement from said first hold down means for maintaining said folded end panel in overlying relationship with said associated sidewall panel until said folded end panel is engaged by a second end panel hold down means;

insert panel lug means affixed at equal interval spacing to said conveyor means for engaging said trailing edge portion of each insert panel fed to said insert panel conveyor means for maintaining a predetermined spacing interval between insert panels on said insert panel conveyor belt means, the movement of said insert panel lug means being timed relative to the movement of said carton blank lug means such that each infed insert panel is deposited on top of a sensed carton blank at a position thereon forward of the forwardmost edge of said folded end panel on said carton blank;

drag means positioned along said carton blank displacement path for applying a retarding force to each insert panel after it leaves said insert panel conveyor means for displacing said insert panel rearwardly relative to a container blank upon which it is deposited for urging said trailing edge portion of said insert panel into abutting relationship with said folded end panel on said container blank;

compression nip means positioned along said carton displacement path downstream of said drag means for applying compressive force to each carton blank and an associated insert panel in said predetermined region where said adhesive has been applied to said carton blank;

second end panel hold down means positioned above said carton blank displacement path for maintaining said folded end panel in overlying relationship with said associated sidewall panel along a second predetermined length of said carton blank displacement path;

whereby each insert panel is adhesively attached to a carton blank with said insert panel trailing edge positioned in registration with a score line which separates a carton blank sidewall panel from an associated second end panel.

13. A method of preparing a plurality of flat carton blanks and flat insert panels for folding and gluing into reinforced carton configurations comprising the steps of:

moving the carton blanks along a predetermined displacement path;

deforming each carton blank to provide a surface projecting transversely of the direction of carton displacement;

laying an insert panel on said one flat surface of each carton blank moving along said displacement path;

placing each insert panel in a predetermined registration position with an associated carton blank by urging a predetermined edge portion of each insert panel into abutting relationship with said projecting surface on an associated carton blank;

fixedly attaching each registeringly positioned insert panel to each associated carton blank.

14. The method of claim 13 wherein said step of deforming said carton blank comprises folding an end panel portion of said carton blank.

15. The method of claim 14 wherein said step of placing each insert panel in a predetermined registration position comprises retarding the movement of the insert panel relative to the movement of the associated carton blank.

16. The method of claim 15 wherein the step of fixedly attaching each registeringly positioned insert panel to an associated carton blank comprises the steps of:

applying an adhesive agent on said one flat surface of each carton blank prior to laying an insert panel thereon;

subsequent to registration of the insert panel with a carton blank compressing the insert panel and the carton blank between a pair of compression surfaces.

17. The invention of claim 16 comprising the further step of detecting the passage of each carton blank along the carton blank displacement path and performing at least one of the steps of applying an adhesive agent to each carton blank and laying an insert panel on each carton blank in response to the detection of each carton blank.

* * * * *

UNITED STATES PATENT AND TRADEMARK OFFICE

CERTIFICATE OF CORRECTION

PATENT NO. : 5,108,355

DATED : April 28, 1992

INVENTOR(S) : JOSEPH C. WALSH

It is certified that error appears in the above-indentified patent and that said Letters Patent is hereby corrected as shown below:

Column 4, line 29, "potion" should read --portion--.

Column 7, line 45, "220 222" should read --220,222--.

In the Claims:

Claim 12, Column 10, line 33, "panel hold" should read --first end panel hold--.

Signed and Sealed this

Thirty-first Day of May, 1994

Bruce Lehman

*Attest:*

BRUCE LEHMAN

*Attesting Officer*

*Commissioner of Patents and Trademarks*